United States Patent [19]

Zitser et al.

[11] 4,308,909

[45] Jan. 5, 1982

[54] APPARATUS FOR MANUFACTURING FOUNDRY CORES

[76] Inventors: Vitaly A. Zitser, ulitsa Pervomaiskaya, 9/4, kv. 17, Dolgoprudny Moskovskoi oblasti; Alexandr V. Melnikov, ulitsa Dorozhnaya, 7, korpus 1, kv. 138, Moscow; Leonid V. Bachelis, Schelkovskoe shosse, 91, korpus 2, kv. 221, Moscow; Nikolai K. Shishkin, ulitsa Yablochkova, 29, kv. 17, Moscow; Jury E. Morozov, Leninsky prospekt, 39/1, kv. 264, Moscow; Vladimir A. Ivanov, ulitsa Rustaveli, 3, korpus 6, kv. 34, Moscow; Semen A. Olshansky, Dmitrovskoe shosse, 37, kv. 306, Moscow; Igor I. Dreishev, Volgogradsky prospekt, 181, kv. 33, Moscow; Eduard A. Stolyar, Krasnostudenchesky proezd, 19, kv. 8, Moscow; Vladimir S. Kushelman, Proletarsky prospekt, 83, kv. 12, Moscow; Eduard G. Shartner, ulitsa Krylova, 4a, kv. 21, Karaganda; Vladimir D. Abaskalov, bulvar Mira, 47, kv. 30, Karaganda; Vladimir A. Levinson, ulitsa N. Abdirova, 46/2, kv. 47, Karaganda, all of U.S.S.R.

[21] Appl. No.: 69,524

[22] Filed: Aug. 24, 1979

[51] Int. Cl.[3] ..... B22D 13/16; B22D 15/08

[52] U.S. Cl. ..... 164/207; 141/284; 164/186

[58] Field of Search ..... 164/37, 169, 188, 192, 164/193, 207, 228; 141/284

[56] References Cited

U.S. PATENT DOCUMENTS

| | | | |
|---|---|---|---|
| 534,415 | 2/1895 | Walstrom | 164/192 |
| 2,243,092 | 5/1941 | Eteau | 164/193 |
| 3,802,484 | 4/1974 | Ovodov et al. | 164/228 |

FOREIGN PATENT DOCUMENTS

| | | | |
|---|---|---|---|
| 2239057 | 6/1975 | Fed. Rep. of Germany | 164/228 |
| 507395 | 4/1976 | U.S.S.R. | 164/186 |
| 619218 | 8/1978 | U.S.S.R. | 164/228 |

*Primary Examiner*—Gus T. Hampilos
*Attorney, Agent, or Firm*—Fleit & Jacobson

[57] ABSTRACT

A feature of the present invention is that an apparatus comprises an actuator of mechanisms for pressing and moving a batching chamber with a double-action cylinder whose internal ram is connected rigidly to a pressing plunger, and an external ram, to the batching chamber formed with interconnected parts having a horizontal groove at the point of their connection, the horizontal groove accommodating an additional gate with a port operated by an independent actuator. The internal ram mounts a device for adjusting the position of the pressing plunger, whereas the top head of the actuator of the mechanisms for pressing and moving the batching chamber accommodates a device for adjusting the position of the batching chamber, the top part of the batching chamber having a port providing access to the device adjusting the position of the pressing plunger.

6 Claims, 1 Drawing Figure

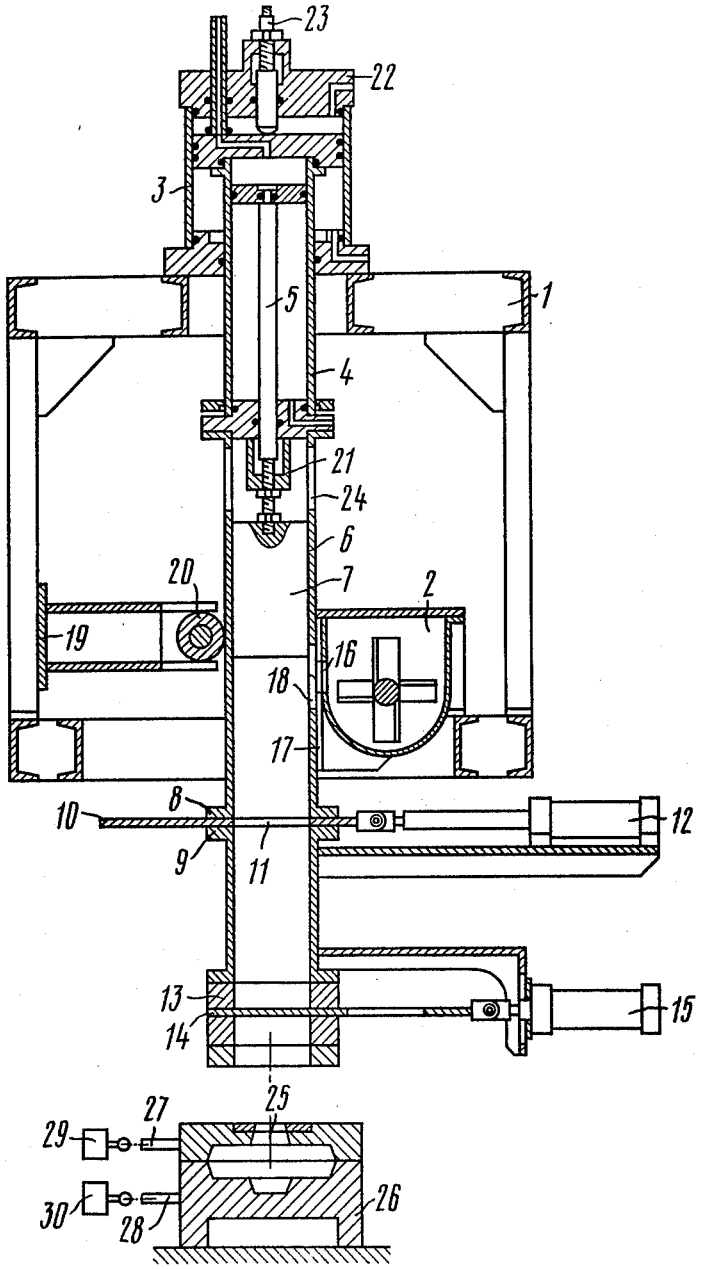
23
22
3
5
1
4
21
24
6
20
7
2
19
16
18
17
8
10
12
9
11
13
15
14
25
27
29
26
30
28

APPARATUS FOR MANUFACTURING FOUNDRY CORES

BACKGROUND OF THE INVENTION

1. Field of the Invention

The invention relates to foundry and more particularly to apparatus for manufacturing foundry cores from fluid sands which are pressed into heated core boxes.

The invention can be used at sanitary engineering, machine building, electrical engineering, automotive production plants and in various industries of mass or large-lot scale of production.

2. Description of the Prior Art

A method and equipment, developed in the USSR, for manufacturing foundry cores by pressing fluid sands into heated core boxes are gaining an ever wider recognition at the present time. These innovations provide a means for obtaining single-piece cores with a natural internal canal ensuring an ideal removal of gases in the course of pouring.

There is known a machine for manufacturing cores from fluid sands (see FRG Pat. No. 2,239,057, Cl. B 22 C 9/10).

The machine comprises a sand preparation mechanism including a continuous-action mixer and a device for feeding starting sand components therein, a batching chamber, a damper with an expansible conical nozzle actuated by a compressed-air cylinder, a pressing cylinder with a plunger, a final pressing cylinder with a final pressing plunger, an elevator and a lifting table.

The machine operates in the manner below.

Fluid sand is fed from the mixer into the batching chamber, after which a mixer port is shut off by a special gate. The damper is moved by a compressed-air cylinder into a position where the conical nozzle secured thereon aligns itself with the batching chamber. The top diameter of the conical nozzle corresponds to the diameter of the batching chamber, and the bottom diameter, to that of an inlet orifice of a core box. A heated core box is forced by the table against the nozzle which is then contracted. The pressing piston is caused by the pressing cylinder to move downward and pack sand into the core box. Once this is completed, sand is given a final pressing by the final pressing plunger actuated by the final pressing cylinder. The diameter of the final pressing cylinder is somewhat smaller than that of the inlet orifice of the core box, and the cylinder is thus capable of penetrating inside the conical nozzle. After sealing, the core box is transferred to a drying station, a fresh core box being placed on the table. The damper is moved to initial position, flaps of the nozzle move apart, and remaining sand falls onto the elevator which returns them to the mixer.

The pressing and the final pressing cylinders raise their plungers into initial position, a special gate opens the port of the mixer and sand fills again the batching chamber.

As the diameter of the batching chamber is, as a rule, several times greater than the diameter of the inlet orifice of the core box, it is necessary to increase considerably the height and, therefore, the volume of the conical nozzle. Sand remaining in the nozzle loses its process properties, can no longer be used for filling another core box and must be removed before a next pressing takes place. When compressed, a sand which has lost its flowability sticks firmly to walls of the nozzle, so that it proves impossible to remove it without special cleaning devices.

The nozzle of the machine, consisting of two sliding parts actuated by cylinders, while being complicated in design, still fails to clean sand off the nozzle effectively. Another consideration is that the nozzle fails to contract tightly should some sand stick to the parting plane, this involving a risk of sand "leakage". Sand remaining in the nozzle, first, renders difficult the filling of the core box with a fresh portion of sand, and second, may fall as lumps into the core box and thus impair the quality of cores.

The use of the elevator in the known machine for returning unused sand to the mixer only complicates the machine, while failing to perform its function adequately. The underlying cause is that the sand possesses a high glueing ability, so that the elevator is "plugged" and thus disabled in a short length of time.

Guides, wherein the gate slides, are blocked with sand when the gate is in top position, so that no reliable closing of the port of the mixer and isolation of the batching chamber from the mixer are obtainable.

Still another shortcoming of the machine is its sliding damper with a nozzle secured thereto. When sand is pressed into the core box through an inlet orifice whose cross sectional area is many times smaller than that of the batching chamber, the pressure therein rises and forces sand out through all the gaps, including those between the batching chamber and the damper. These gaps are also penetrated by sand from the batching chamber when the damper with the nozzle slides into working position. Sand blocking the gaps rapidly hardens in the air, heat radiation from the heated core boxes enhancing the process. This results in frequent blocking of the damper, stoppage of the machine for cleaning rubbing surfaces from stuck sand.

The final pressing operation in the known machine provides no beneficial effect and not only complicates the design and the efficiency thereof, but also overpacks core prints to hinder the formation of voids therein and the communication thereof with the atmosphere using vent wires.

Still another shortcoming of the machine is a lack of means for metering (adjusting the volume of the batching chamber) fluid sand over a wide range and manufacturing, without re-conversion, cores substantially (by two and more times) differing in weight.

The lack of sand metering makes it impossible to manufacture quality cores of any specified mass, to stabilize the weight of cores and the size of the natural canal, to minimize or eliminate altogether waste of sand.

Process potentialities of the machine and the range (by weight) of cores manufactured thereby are reduced by the lack of sand metering.

Changing the machine from the manufacture of one type of cores to another requires re-conversion which consists in the replacement of subassemblies (batching chamber, pressing plunger and others) of the machine, complete replacement of one set of core boxes and necessitates much time. The fact that no cores differing in weight can be manufactured simultaneously on the machine calls for a substantial increase in the number of core boxes.

SUMMARY OF THE INVENTION

It is therefore an object of the invention to provide an apparatus capable of manufacturing simultaneously cores substantially differing in weight.

Another object of the invention is to stabilize the weight of cores and the magnitude of a natural canal therein.

Still another object of the invention is to widen the range of cores (by weight).

Yet another object of the invention is to provide a reliable operation of the apparatus and raise its efficiency.

A further object of the invention is to eliminate production waste.

The above and other objects are attained in an apparatus for manufacturing foundry cores from fluid sands, comprising a supporting frame with mounted thereon mixer and actuator of mechanisms for pressing and moving a batching chamber, the batch chamber incorporating a pressing plunger, a cylindrical nozzle secured to the bottom part of the batching chamber formed with a package of interconnected elements having a built-in gate, and a gate cylinder, according to the invention, the actuator of mechanisms for pressing and for moving the batching chamber has a double-action cylinder whose internal ram is rigidly connected to the pressing plunger, and the external ram, to the batching chamber built of interconnected parts with a groove at the place of their connection, the groove receivs an additional gate with a port, operated by an independent actuator.

It is advantageous to mount on the internal ram a device for adjusting the position of the pressing plunger and to incorporate in the top head of the actuator of the mechanisms for pressing and for moving the batching chamber a device for adjusting the position thereof, the top part of the batching chamber having a built-in port for access to the device adjusting the position of the pressing plunger.

According to the invention, a fluid sand is fed from a mixer to a batching chamber whose working volume is governed by the position of the gates and the adjusting devices. If the operation of the apparatus requires a largest possible volume of the batching chamber, the top gate is permanently open. Should a lesser volume of the batching chamber be necessary, it is the bottom gate which is permanently open.

The actuator of the pressing mechanism makes a first stroke with the effect that the external ram descends, the pressing chamber then reliably shutting off a discharge port of the mixer and being forced by the nozzle against a core box, this cutting off sand in the batching chamber from that in the mixer. The gate operating in the given cycle then moves so that the axis of the port thereof aligns itself with that of the batching chamber. The actuator of the pressing mechanism makes a second stroke to move the internal ram with the pressing plunger downward and force sand from the batching chamber into a core box in a manner that the batching chamber and the nozzle are completely freed of sand. The batching chamber and the pressing plunger then rise to initial position, the core box is sealed and removed from the pressing station, the working gate shutting off the batching chamber which is filled with a fresh portion of sand through the mixer port. The corresponding gate is put into operation when re-converting the apparatus from one type of core to another from a control desk, in accordance with process conditions require it. The corresponding gates in simultaneous manufacture of cores of different weights are actuated automatically as follows. A core box for manufacturing cores of lesser weight acts by its differentiating pin upon a pickup which energizes the top gate for a given cycle of operation, a small portion of sand then being accumulated in the batching chamber. When large cores are to be fabricated, corresponding core boxes act by their differentiating pin upon a pickup which energizes the bottom gate for a given cycle of operation, a large portion of sand then being fed into the batching chamber.

If no sand is to be accumulated in the batching chamber, the batching chamber remains in the bottom position, the mixer port then being shut off as before.

The working volume of the batching chamber can be set for a small portion by adjusting devices on the internal ram and the top head of the actuator for moving the batching chamber and for pressing. The batching chamber can be adjusted for a large-portion working volume, independently of the above adjustment, by setting the bottom gate at an appropriate height (through an adequate selection of the thickness of the nozzle elements), so that the aggregate volume of the batching chamber and of the part of the nozzle above the gate meets the required conditions.

The apparatus according to the invention improves operational reliability, is of a simple design, features a high capacity, stabilizes to a maximum possible degree the weight of cores and the magnitude of their internal canal, is rated to manufacture cores substantially differing in weight without re-converting the apparatus and to fabricate various cores in a single simultaneous automatic production flow and, finally, materially reduces the number of required core boxes.

A high accuracy of the adjustment of the batching chamber working volume eliminates all sand waste and contributes to a self-cleaning of the batching chamber-nozzle system in the process of pressing.

BRIEF DESCRIPTION OF THE DRAWINGS

These and other objects and features of the invention become readily apparent from one embodiment thereof which will now be described by way of example with reference to the accompanying drawing, in which:

The FIGURE is a cross sectional general view of an apparatus for manufacturing foundry cores.

DESCRIPTION OF THE PREFERRED EMBODIMENT

An apparatus (the FIGURE) comprises a supporting frame 1 with mounted thereon a mixer 2 and an actuator 3 of mechanisms for pressing and for moving a batching chamber with an external ram 4 and an internal ram 5. The ram 4 carries the batching chamber 6, and the ram 5, a pressing plunger 7 built into the batching chamber 6. The batching chamber 6 consists of interconnected top 8 and bottom 9 parts, the gap therebetween accommodating an additional gate 10 with a port 11, actuated by a cylinder 12. A nozzle 13, formed with a package of interconnected elements having a built-in gate 14 actuated by a cylinder 15, is attached to the bottom part 9 of the batching chamber 6.

The mixer 2 is provided with a distance port 16 and a bracket 17 which is permanently adjoined by a port 18 of the batching chamber 6. The supporting frame 1 receives a cage 19 with rollers 20 serving as guides of the batching chamber. The position of the pressing plunger 7 on the ram 5 is adjusted by a device 21, and that of the batching chamber 6 on a head 22 of the actuator 3, by a device 23. A port 24 provides access to the device 21. Sand is pressed through an orifice 25 of a core box 26 which incorporates differentiating pins 27 or 28 acting respectively on pickups 29 or 30.

OPERATION

The apparatus operates in the manner below.

Fluid sand is fed through the port 16 of the mixer 2 and the port 18 into the batching chamber 6, working volume thereof being controlled by the positions of the gates 10 and 14 and of the adjusting devices 21 and 23.

If the operation of the apparatus calls for a large volume of the batching chamber 6, the gate 10 is set permanently in a position where the axis of its port is aligned with that of the batching chamber 6. The large volume adjustment is made by setting the gate 14 at an appropriate height (through an adequate selection of the thickness of the nozzle elements), so that the aggregate volume of the batching chamber 6 and the part of the nozzle 13 above the gate 14 meets the required conditions.

If operations require a lesser volume of the batching chamber 6, the port of the gate 14 is permanently aligned with the axis of the batching chamber 6, the adjustment for the smaller volume being performed jointly by the devices 21 and 23 independently of the initial adjustment.

The actuator 3 of the pressing mechanism makes a first stroke with the effect that the ram 4 descends, whereas the batching chamber 6 shuts off the port 16 of the mixer 2, the nozzle 13 of the batching chamber 6 being forced against the core box 26, the sand in the batching chamber 6 then being isolated from sand in the mixer 2. The gate now in operation is moved by its cylinder into a position where the axis of its port aligns itself with the axis of the batching chamber port. The actuator 3 of the pressing mechanism effects a second stroke with the effect that the ram 5 with the pressing plunger 7 descends to force sand from the batching chamber 6 into the core box 26 through the orifice 25. Next, the batching chamber 6 and the pressing plunger 7 rise to initial position, the core box 26 is sealed and removed from the pressing station, whereas the operating gate shuts off the batching chamber which is filled with a fresh portion of sand through the port 18. If the supply of sand to the batching chamber 6 is to be cut off, the batching chamber 6 remains, on command from the control desk, in the bottom position, the port 16 of the mixer 2 stays shut, and the automatic operation of the apparatus is not discontinued.

Energizing of a corresponding gate on conversion of the apparatus from the manufacture of one type of cores to another is effected from the control desk when a process need arises.

When cores of different weights are manufactured simultaneously on the apparatus, the corresponding gate is operated automatically in the manner below. A core box intended for fabricating cores of smaller weight acts by a differentiating pin 27 thereof upon a pickup 29 which initiates a given cycle of operation of the gate 10, a smaller portion of sand then being fed into the batching chamber 6.

When cores of a large weight are required, a core box acts by a differentiating pin 28 thereof upon a pickup 30 which puts into operation the gate 14 for a given cycle, a large portion of sand then being fed to the batching chamber 6.

As both the large and the small volumes of the batching chamber can be adjusted accurately and independently, sand is expelled into a core box in totality, the pressing plunger 7 passing in the process through the batching chamber-nozzle system, cleaning it at every cycle.

The above apparatus provides a high capacity, produces cores of excellent quality, is simple in design, is rated to fabricate without re-conversion cores differing substantially in weight and to manufacture various types of cores in a single production flow.

What is claimed is:

1. An apparatus for manufacturing foundry cores from fluid sand, comprising a supporting frame, a mixer mounted on said supporting frame for mixing said sand, a batching chamber adapted to receive sand from said mixer, a mechanism for moving said batching chamber having an external ram operatively associated with said batching chamber, a mechanism for pressing said sand having an internal ram housed within said external ram, a first actuator mounted on said supporting frame for actuating said mechanisms, said first actuator supporting said mechanism for moving said batching chamber, said batching chamber being secured to said external ram and having interconnected top and bottom parts, said batching chamber having a first groove defined between said top and bottom parts, a first gate having a first port mounted in said first groove of said batching chamber, a second actuator operatively associated with said first gate for moving said first gate from a position in which said first port is aligned with said batching chamber to a blocking position in which said first port is out of alignment with said batching chamber, a pressing plunger housed inside said batching chamber and attached to said internal ram, a nozzle secured to the bottom part of said batching chamber formed from a plurality of interconnected elements defining a second groove, a second gate having a second port mounted in said second groove of said plurality of interconnected elements, and a third actuator operatively associated with said second gate for moving said second gate from a position in which said second port is aligned with said batching chamber to a position in which said second port is out of alignment with said batching chamber.

2. The apparatus of claim 1 further comprising a first device operatively associated with said internal ram for adjusting the position of said pressing plunger within said batching chamber and a second device operatively associated with said first actuator and said external ram for adjusting the position of said batching chamber, said top part of said batching chamber having a third port for access to said first device for adjusting the position of said pressing plunger.

3. The apparatus of claim 1 in which said batching chamber includes a port for receiving sand from said mixer.

4. The apparatus of claim 1 further comprising a roller mounted to said supporting frame for guiding the movement of said batching chamber.

5. The apparatus of claim 1 further comprising a core box positioned adjacent said nozzle for receiving sand from said nozzle.

6. The apparatus of claim 5 further comprising means associated with said core box for actuating said second and third actuators for moving said first and second ports into and out of alignment with said batching chamber.

* * * * *